US005606400A

United States Patent [19]

Nagayasu et al.

[11] Patent Number: 5,606,400

[45] Date of Patent: Feb. 25, 1997

[54] IMAGE FORMING APPARATUS WITH A MEMBER FOR SHAVING THE SURFACE OF A PHOTOSENSITIVE MEMBER

[75] Inventors: Keiko Nagayasu, Ibaraki; Akihito Ikegawa, Sakai, both of Japan

[73] Assignee: Minolta Co., Ltd., Osaka, Japan

[21] Appl. No.: 551,759

[22] Filed: Nov. 7, 1995

[30] Foreign Application Priority Data

Nov. 8, 1994 [JP] Japan ..... 6-273607

[51] Int. Cl.[6] ..... G03G 15/02

[52] U.S. Cl. ..... 399/168; 399/343; 399/150

[58] Field of Search ..... 355/211, 219, 355/269, 296, 301, 302, 303, 304, 297; 430/125

[56] References Cited

U.S. PATENT DOCUMENTS

| | | | |
|---|---|---|---|
| 3,910,697 | 10/1975 | Lanker | 430/125 |
| 3,947,108 | 3/1976 | Thettu et al. | 355/297 |
| 4,469,435 | 9/1984 | Nosaki et al. | 355/15 |
| 5,148,219 | 9/1992 | Kohyama | 355/219 |
| 5,430,527 | 7/1995 | Maruyama et al. | 355/219 |

FOREIGN PATENT DOCUMENTS

| | | | |
|---|---|---|---|
| 61-107357 | 5/1986 | Japan | 355/219 |
| 62-245277 | 10/1987 | Japan . | |
| 5-127492 | 5/1993 | Japan . | |
| 5-119579 | 5/1993 | Japan | 355/219 |

*Primary Examiner*—Joan H. Pendegrass
*Attorney, Agent, or Firm*—Brinks Hofer Gilson & Lione

[57] ABSTRACT

An image forming apparatus for forming a latent image on a photosensitive member, developing the latent image by a developing device to transfer the developed image onto a recording paper, and cleaning residual toner on the photosensitive member after transferring by the developer. The photosensitive member has a hardness such that a conical diamond produces on a surface of the photosensitive member a scratch of 30 μm or greater but no more than 180 μm in width, when the diamond scratches the surface of the photosensitive member under a vertical load of 50 g and relative speed of 100 mm/min, the diamond having a conical angle of 120° and hemisphere shaped leading edge with a radius of 0.2 mm. The image forming apparatus further includes at least one rotational brush provided in contact with the photosensitive member under the conditions of:

$$100\ \text{mm} \geqq W \times |Vr - Vp| / Vp \geqq 10\ \text{mm},$$

wherein W is a nip width of the brush relative to the photosensitive member, Vr is a rotational speed of the brush and Vp is a rotational speed of the photosensitive member.

6 Claims, 5 Drawing Sheets

IMAGE FORMING APPARATUS WITH A MEMBER FOR SHAVING THE SURFACE OF A PHOTOSENSITIVE MEMBER

BACKGROUND OF THE INVENTION

1. Field of the Invention

The present invention relates to an image forming apparatus such copiers, printers and the like using electrophotographic methods.

2. Description of the Related Art

In image forming apparatus such as copiers, printers and the like using electrophotographic methods, typically charge a photosensitive drum by means of a charger, perform optical image exposure of said charged region so as to form an electrostatic latent image on the surface of said drum, said latent image then being developed so as to produce a visible image which is then transferred to a transfer member and fixed thereon.

In recent years, various apparatus have been proposed which omit a cleaning device in conjunction with demand for inexpensive and more compact apparatus.

For example, U.S. Pat. No. 5,148,219 discloses a so-called cleanerless image forming apparatus which combines a cleaning device with the developing device. Furthermore, U.S. Pat. No. 4,469,435 discloses a cleanerless image forming apparatus which combines a cleaning device with a charger having a contact member which makes contact with a photosensitive member. In this instance, the contact-type charger accomplishes cleaning by electrostatically adhering residual developer to the charging member.

The aforesaid cleanerless image forming apparatus, however, pose the following disadvantages.

In image forming apparatus provided with a cleaning device, the photosensitive member is shaved simultaneously with the removal of the residual developer from the surface of the photosensitive member by means of a cleaning member such as a blade, brush or the like, but when such a cleaning device is not provided, ozone accumulation causes deterioration of the surface of the photosensitive member and results in toner filming because a suitable shaving member is not provided for the photosensitive member. Ozone-induced deterioration is a phenomenon wherein ozone generated by a charger, transfer device or the like corrodes the surface of the photosensitive member. Toner filming is a phenomenon wherein a thin film of toner, i.e., developer, adheres to the entire surface of the photosensitive member.

When ozone-induced deterioration or toner filming occurs and electrostatic latent images are formed, and particularly when latent images are formed under conditions of high temperature and high humidity, there is a horizontal drift of the charge on the surface of the photosensitive member which disrupts said latent image, causing so-called image drift. The occurrence of image drift, for example, in the case of reversal development wherein toner is adhered to the optically exposed regions in a halftone dot pattern image such as shown in FIG. 6, the surface potential of the photosensitive member (e.g., −600 V) is locally reduced (e.g., to −50 V) in dot-like spots d1 by optical exposure, as shown in FIG. 7A, at which locations the dot to be developed in black or other color is eliminated due to charge drift, as shown in FIG. 7B.

SUMMARY OF THE INVENTION

A main object of the present invention is to provide a cleanerless image forming apparatus capable of normally forming excellent images.

Another object of the present invention is to provide a cleanerless image forming apparatus which prevents image drift.

A further object of the present invention is to provide a cleanerless image forming apparatus capable of preventing toner filming and ozone accumulation on the surface of a photosensitive member.

These and other objects of the present invention is accomplished by an image forming apparatus comprising a photosensitive member having a hardness such that a conical diamond produces on a surface of the photosensitive member a scratch of 30 μm or greater but no more than 180 μm in width, when the diamond scratches the surface of the photosensitive member under a vertical load of 50 g and relative speed of 100 mm/min, the diamond having a conical angle of 120° and hemisphere shaped leading edge with a radius of 0.2 mm, a developing device for developing a latent image formed on the photosensitive member and for cleaning residual toner on the photosensitive member after transferring the developed image onto a paper and at least one rotational brush provided in contact with the photosensitive member under the conditions of $100\ \text{mm} \geqq W \times |Vr - Vp|/Vp \geqq 10\ \text{mm}$, wherein W is a nip width of the brush relative to the photosensitive member, Vr is a rotational speed of the brush and Vp is a rotational speed of the photosensitive member.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 3A shows a pile woven on a textile base; FIG. 3B shows a pile woven on a synthetic resin base member;

DETAILED DESCRIPTION OF THE PREFERRED EMBODIMENTS

The inventors have considered countermeasures for the previously mentioned problems by shaving the surface of the photosensitive member by uniform amounts. A rotating brush is suitable for use as a shaving member capable of suitably uniformly shaving the photosensitive member. If the mutual setting conditions of the photosensitive member and the rotating brush as well as hardness of the photosensitive member 1 are determined within a specific range, the present invention completely prevents or suitably suppresses toner filming and ozone accumulation.

The preferred embodiments of the present invention are described hereinafter with reference to the accompanying drawings.

The present invention is first described in terms of the rotating brush capable of suitably shaving the photosensitive member.

Figure 3:
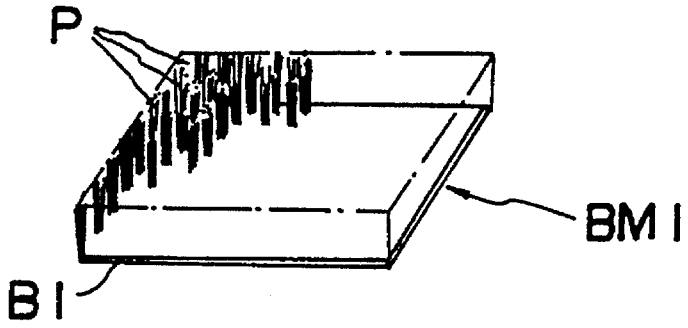
FIG. 3 shows examples of the construction of the brush member forming the basis of the rotating brush for shaving the photosensitive drum.
Figure 3:
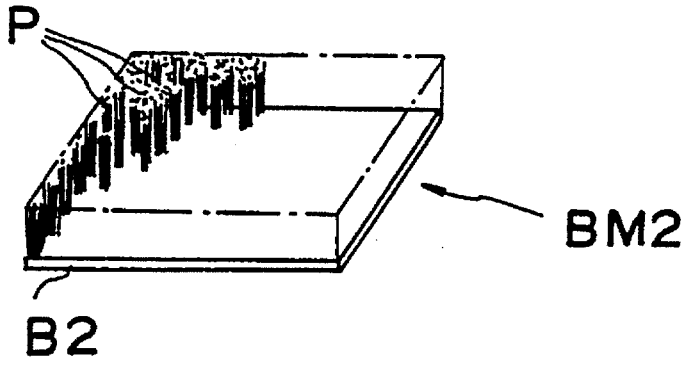

The brush member forming the basis of the rotating brush for saving the photosensitive member may be a typical member having a so-called velveteen (velvet) fabric construction from the perspectives of having desired strength mass-production characteristics, fiber density and the like. As shown in FIG. 3A, pile P comprising the brush fibers are woven at equal spacing on base B1 as a base member to form BM1. Alternatively, as shown in FIG. 3B, pile P comprising the brush fibers may be implanted at equal spacing in sheet-like flexible synthetic resin base member B2 to form BM2. In either case, each pile is typically considered as groupings of 20~200 brush fibers of about 3~10 deniers.

Figure 4:
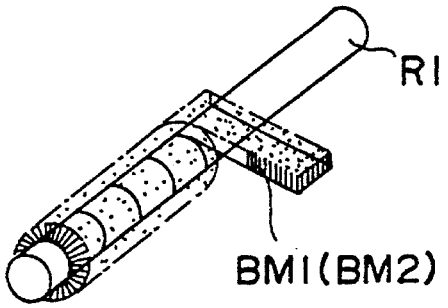
FIGS. 4A, 4B, 4C, 4D, and 4E respectively show examples methods for forming the brush member as indicated in FIGS. 3A and 3B into a rotating brush.
Figure 4:
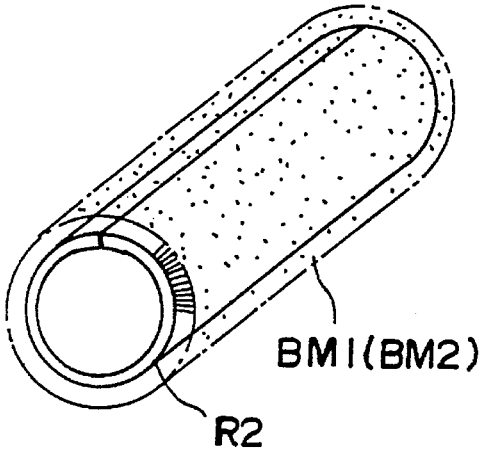
Figure 4:
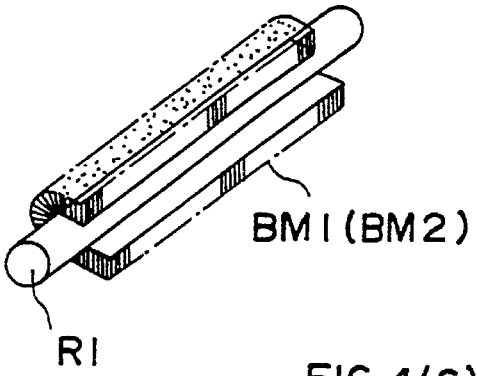
Figure 4E:
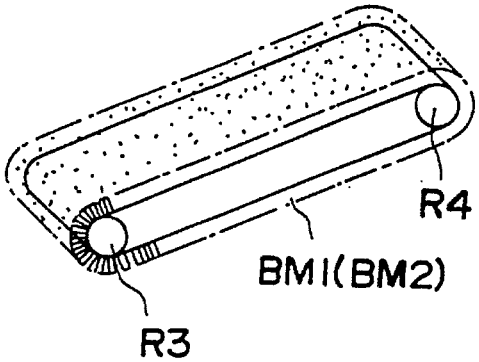
Figure 4C:
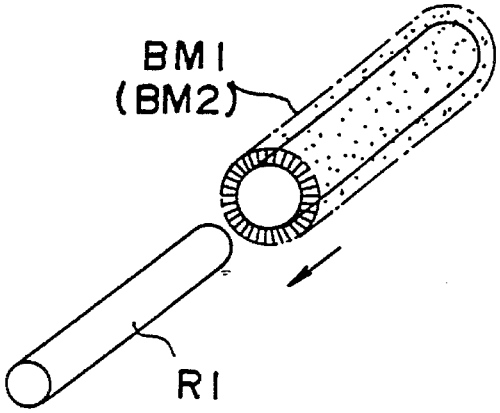

The brush members BM1 and BM2 of types shown in FIGS. 3A and 3B may be wound in a spiral configuration around the surface of rotatably driven core R1 as shown in FIG. 4A, a flat winding as shown in FIG. 4B, a preformed cylindrical configuration adhered with adhesive as shown in FIG. 4C, and a plate-like member R2 rolled in a cylindrical shape on the surface of which was wrapped a brush member the edge portion of which is fitted between the protruding edges of the sheet-like member so as to be rotatable. At this time, these aforesaid members may be adhered by adhesive. In the brush member preformed as an endless belt as shown in FIG. 4E, said member may be wound around pulleys R3 and R4 at least one of which is rotatably driven.

Figure 5:
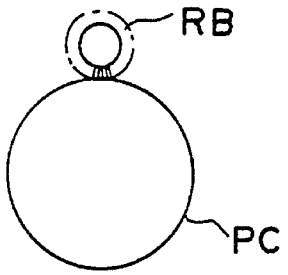
FIGS. 5A, 5B, and 5C show examples of the state of contact between the rotating brushes of FIG. 4 with respect to the photosensitive member.
Figure 5:
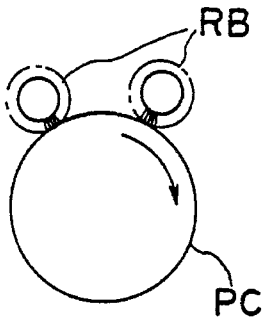
Figure 5:
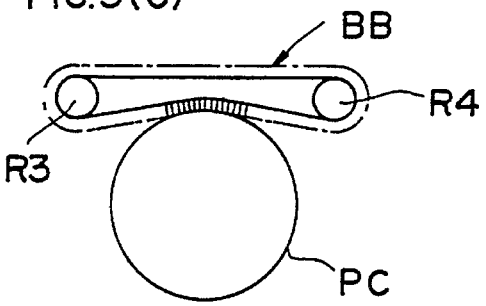

The aforesaid roller type and belt type rotating brushes RB and BB make contact with the surface of photosensitive member PC, as shown in the examples of FIGS. 5A through 5C.

A rotating brush used to shave the surface of the photosensitive member may be combined with a charging member; in such a case, rod R1, plate-like member R2, and pulleys R3 and R4 may be electrically conductive members formed of conductive metal, conductive synthetic resin, insulated material surface-treated for electrical conductivity and the like, and the adhesive used may be an electrically conductive adhesives to allow the application of a voltage.

FIG. 5A shows a single roller-type rotating brush RB in a state of contact with contact with a photosensitive member. FIG. 5B shows two roller-type rotating brush members RB in a state of dual contact with the photosensitive member.

FIG. 5C shows a belt-like rotating brush BB supported by pulleys R3 and R4 such that the line connecting said pulleys provided a state of contact at a right angle with respect to the rotating shaft of the photosensitive member. The present invention is suitable for all the aforesaid configurations.

Various types of materials have been considered as the brush fibers comprising the rotating brush for shaving the photosensitive member, and when, for example, a charging member is combined with said rotating brush, consideration should be given to chargeability of the photosensitive member, hardness of the surface of the photosensitive member, diameter of the photosensitive member, positional relationships of the rotating brush and other elements, system speed of the apparatus and the like. For example, materials may be suitable selected for electrical resistivity, flexibility, hardness, shape, strength and the like so as to obtain a desired amount of charge by applying a charge voltage comprising a voltage of a direct current (DC) component alone or a voltage including an alternating current (AC) component overlaid on a DC component, however, the materials are not specifically limited.

Examples of materials useful as conductive metal brush fibers include metal fibers such as tungsten, stainless steel, gold, platinum, aluminum, iron, copper and the like, adjusted to suitable fiber length and fiber diameter.

Examples of conductive resins useful as brush fiber material include fibers comprising rayon, polyamide, cuprammonium, vinylidene, vinylon, ethylene fluoride, benzoate, polyurethane, polyester, polyethylene, polyvinyl chloride, polypropylene and the like in which is dispersed resistance regulating agents such as carbon black, carbon fiber, metal powder, metal whiskers, metal oxides, semiconductive materials and the like. In this case, a suitably desirable resistance value can be obtained by the amount of said dispersed material added to the resin. Furthermore, the resistance regulating material need not be dispersed, and may be used as an overcoating on the fiber surface.

The electrical resistivity of the aforesaid fiber material will typically be such as to obtain a volume resistivity of less than $10^9$ Ωcm, and desirably less than $10^7$ Ωcm so as to achieve desired charging characteristics.

The cross section configuration of the fibers is not specifically limited insofar as charging characteristics are not impaired. Fibers may have a configuration which is circular, rod-like, spiral, polygonal, flat, hollow interior, and like configurations, and easy-to-manufacture configurations may be selected.

When a rotating brush is not used as a charging member, chargeability is unnecessary for the brush since a voltage application is not required, and resistance value of the brush is also not specifically limited. Accordingly, when resin material is used for a brush, processing to disperse a resistance regulating agent such as a conductive material or provide an overcoating of same is unnecessary.

A first embodiment of the present invention is described hereinafter.

Figure 1:
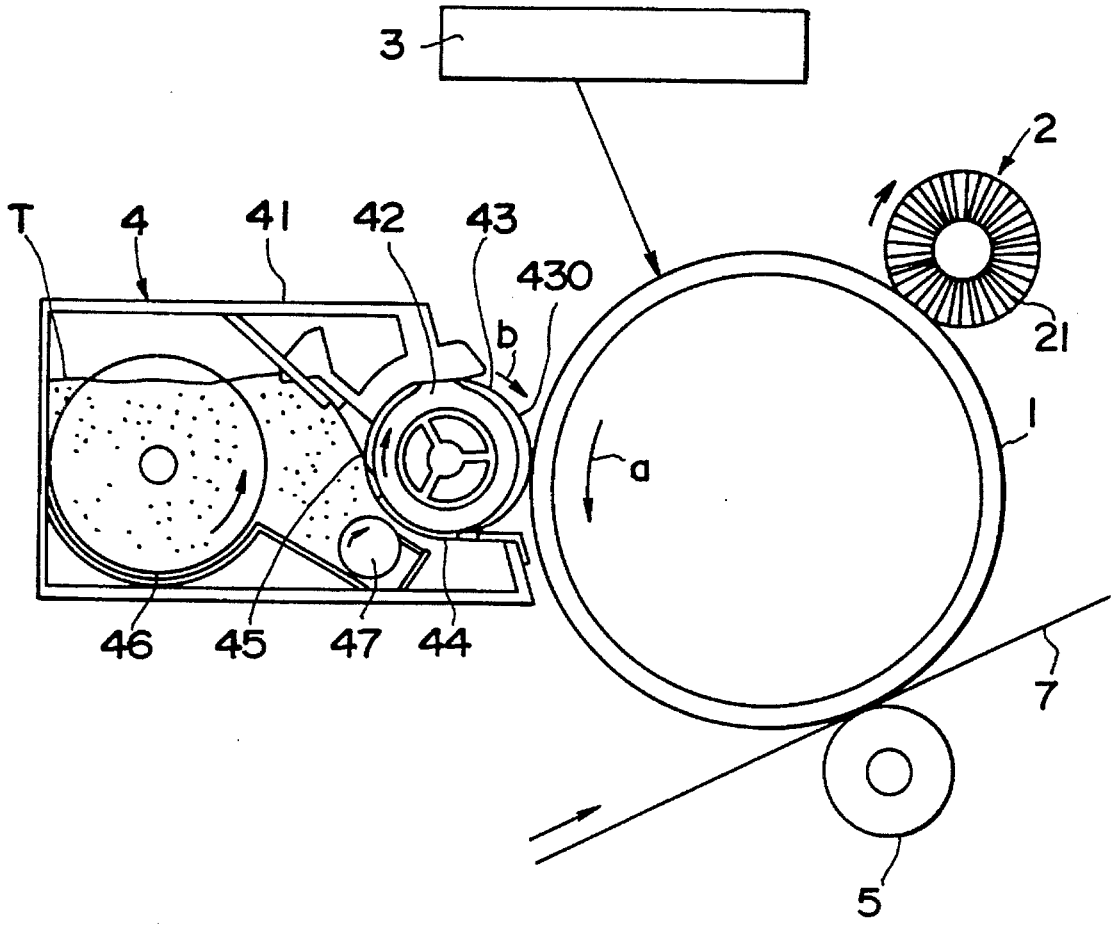
FIG. 1 briefly shows the construction of the essential portion of a printer of a first embodiment of the invention.
Figure 2:
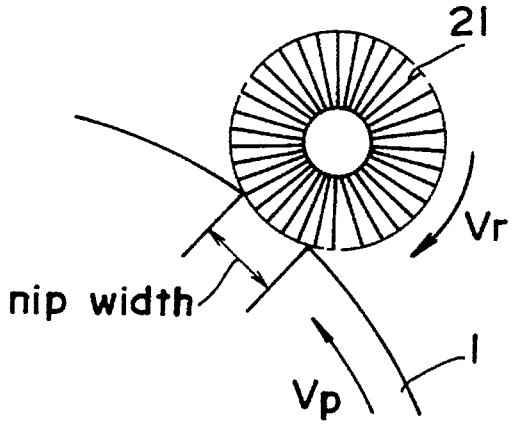
FIG. 2 is an illustration showing the mutual setting conditions for the photosensitive drum and a rotating brush used to shave the photosensitive member.

FIG. 1 briefly shows the construction of a printer of the present invention.

This printer is provided with a photosensitive drum 1 arranged in the center area. Drum 1 is rotatably driven in the arrow a direction at a predetermined rotational speed Vp via a drive device not shown in the illustration. Arranged sequentially around the periphery of drum 1 are brush charger 2, exposure unit 3, developing device 4, and roller-type transfer charger 5.

Brush charger 2 includes rotating brush 21, which makes contact with the surface of photosensitive drum 1 with a predetermined contact width (nip width). Rotating brush 21 receives a charging voltage from a power source not shown in the drawing, and is rotated at rotational speed Vr in the direction of movement of photosensitive drum 1 in the contact region with said photosensitive drum 1 in an opposite direction relative to the direction of rotation of said photosensitive drum 1 via a drive device not shown in the drawing, so as to uniformly charge the surface of photosensitive drum 1 at −500~−1,000 V.

Exposure device 3 uses a well known semiconductor laser, which reduces to about −50 V the charge of the image region of the surface of photosensitive drum 1 previously charged at −600 V.

Developing device 4 is a monocomponent developing device for reversal development, which is provided with a drive roller 42 which is supported in a casing 41 and rotatably driven in the arrow b direction (clockwise direction), and which is sheathed by a flexible developing sleeve 43 which has an internal diameter slightly larger than the external diameter of said roller, both ends of said sleeve being pressed against drive roller 42 via a contact belt member 44 from the interior side of casing 41, so as to form a slack part 430 on the opposite side thereof, such that said slack part makes contact with photosensitive drum 1. Within casing 41, a metal regulating blade 45 abuts developing sleeve 43. Developing sleeve 43 receives a developing bias voltage of −250 V from a power source not shown in the drawing.

The interrelationships among the rotating brush 21, nip width relative to photosensitive drum 1, rotational speed Vp of photosensitive drum 1, and rotational speed Vr of rotating brush 21 are set so as to satisfy the following conditions:

$$100\ \text{mm} \geqq (\text{nip width}) \times |Vr - Vp|/Vp \geqq 10\ \text{mm}$$

Photosensitive drum 1 negative-charging function-separated organic photosensitive member having excellent photosensitivity for long wavelength light such as semiconductor laser light (wavelength: 780 nm), LED light (wavelength: 680 nm) and the like. The surface hardness of the photosensitive drum is such that a conical diamond (conical angle of 120°, leading edge hemisphere radius of 0.2 mm) produces a scratch 30 μm or greater but no more than 180 μm in width when drawn across the surface of photosensitive drum 1 under a vertical load of 50 g and relative speed of 100 mm/min.

A methods for measuring hardness is, for example, a method wherein the photosensitive member is rendered stationary on a movable sample table, and the aforesaid diamond is brought into contact with the surface of the photosensitive member at a vertical load of 50 g, and the sample table is moved at 100 mm/min with the diamond in the aforesaid position, so as to form a scratch on the surface of the photosensitive member, the width of said scratch being measured by a measuring device.

Photosensitive drum 1 is a negative-charging function-separated organic photosensitive member having excellent sensitivity for long wavelength light such as semiconductor laser light (wavelength: 780 nm) and LED light (wavelength: 680 nm), and is manufactured as described below.

One-part-by-weight τ-type nonmetallic phthalocyanine, 2 parts-by-weight polyvinyl butyral resin, and 100 parts-by-weight tetrahydrofuran were mixed for 24 hr using a ball mill to obtain a photosensitive fluid application. At this time, the viscosity of the photosensitive fluid application was 15 cp at 20°. The polyvinyl butyral resin comprised 3 molar % or less acetylation, 70 molar % butylation, and polymerization degree of 1,000.

This fluid application is applied by a dipping method on the surface of a cylindrical substrate measuring 240 mm long and 0.8 mm thick, so as to form, after drying, a charge-generating layer having a layer thickness of 0.4 μm. This cylindrical substrate was an aluminum alloy containing 0.7 percent-by-weight of magnesium and 0.4 percent-by-weight silicon, and the drying conditions were about 30 min in a recirculating air environment at 20° C.

Over the aforesaid charge-generating layer was applied a fluid application comprising 8 parts-by-weight hydrazone compound shown in the structural formula below, 0.1 parts-by-weight orange color (Sumiplast Orange 12; Sumitomo Chemicals, Ltd.) and 10 parts-by-weight polycarbonate resin (Panlite L-1250; Teijin Chemicals, Ltd.) dissolved in a solvent comprising 180 parts-by-weight tetrahydrofuran, said fluid application was dried to form a charge-transporting layer having a layer thickness of 28 μm.

The viscosity of the fluid application at this time was 240 cp at 20° C., and drying conditions were about 30 min in an environment of recirculating air at 100° C.

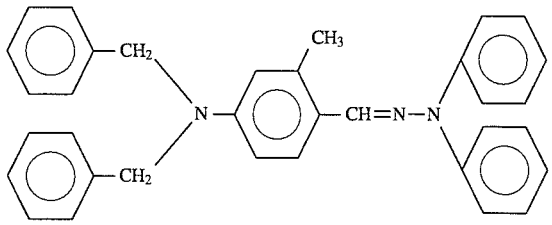

A function-separated type negative- charging organic photosensitive drum 1 having sequential laminations of a charge-generating layer and charge-transporting layer superimposed on a conductive substrate was thus prepared in the previously described manner.

The τ-type nonmetallic phthalocyanine used in the manufacture of the charge-generating layer has an X-ray diffraction pattern exhibiting strong peaks at Bragg angles (2θ±0.2 degrees) of 7.7, 9.2, 16.8, 17.4, 20.4, and 20.9 degrees when a Cu/Kα/Ni X-ray having a wavelength of 1.541 Å is used. In the infrared absorption spectrum, there are four absorption bands between 700~760 $cm^{-1}$ which are most intense at 751±2 $cm^{-1}$, and two absorption bands between 1320~1340 $cm^{-1}$ which have nearly equal intensity of 3288±3 $cm^{-1}$.

The toner used in developing device 4 is described below.

The toner is a negative-charging non-transparent magnetic black toner comprising a mixture of 100 parts-by-weight (hereinafter "pbw") type-A bisphenol polyester resin, 5 pbw carbon black (MA#8; Mitsubishi Chemicals, Ltd.), 3 pbw charge control agent (Bontoron S-34; Orient Kagaku Kogyo K. K.), and 2.5 pbw wax (biscol TS-2050; Sanyo Kasei Kogyo K. K.), said mixture being kneaded, pulverized, and classified by well-known methods to produce toner particles having an 80% weight distribution within a range of 7~13 μm and a mean particle size of 10 μm. To these toner particles was added 0.75 percent-by-weight hydrophobic silica (Tullanox 500; Cabosil Co., Ltd.) as a fluidizing agent, and the materials were mixed using a homogenizer.

The developer and developing method used in the image forming apparatus of the present invention is not limited to those described above. Positive charging toner, transparent toner, magnetic toner, two-component developing method, standard developing method and the like may be suitably selected in accordance with the image forming process used, and polarity of the photosensitive member. Usable colors include not only black toner, but also yellow, magenta, cyan and the like color toners. The shape of the toner may be an indefinite shape, or a specific shape, e.g., spherical. A lubricant such as polyvinylidene fluoride may be added to improve cleaning characteristics.

The aforesaid printer uniformly charges the surface of rotating photosensitive drum 1 to a surface potential of −600 V via brush charger 2, and said charged surface is subjected to optical image exposure via exposure unit 3, so as to form an electrostatic latent image thereon. The surface potential of the exposed region drops to about −50 V. The thus formed electrostatic latent image is developed with toner when a developing bias voltage of −250 V is applied to the developing device 4. During this development, toner T present on the surface of developing sleeve 43 is adhered to the latent image by the potential difference ΔV of 200 V.

Thus, the formed toner image is transferred via a transfer charger 5 onto a transfer sheet 7 transported from a sheet supply means not shown in the drawing, and after said transfer, sheet 7 is separated from the photosensitive drum 1 by a separation means (also not shown in the drawing), and is transported to a fixing device (not illustrated) which fixes the toner image to the transfer sheet 7 which is then ejected. The toner on the surface of photosensitive drum 1, however, is not completely transferred to transfer sheet 7 by transfer charger 5, such that typically 10~20% of the toner remains as residual toner on the drum 1. This residual toner is charged by charger 2, and undergoes the image exposure process by exposure device 3 as necessary and again arrives at developing device 4, whereupon the residual toner of the non-image areas is collected on developing sleeve 43.

When the surface of photosensitive drum 1 with residual toner remaining thereon has been charged and exposed, there is a problem with some of the residual toner not being charged, or exposed, whereas no such problem occurs when the residual toner is disrupted by the rotating brush 21 of brush charger 2. Although dispersion members are required with charging devices such as corona chargers, charging roller, charging blades and the like, such dispersion members are unnecessary when a brush charger is used since the dispersion effect is achieved by the brush charger.

Since the surface hardness of the photosensitive drum 1 in the aforesaid printer is 30 μm or greater but less than 180 μm, and the conditions of 100 mm≧(nip width)×|Vr−Vp|/Vp≧10 mm are satisfied, the surface of photosensitive drum 1 is suitably shaved by the rotating brush 21 of charger 2, such that ozone accumulation and toner filming are prevented or suitably suppressed, so as to produce excellent images without image drift even when forming images of halftone dot patterns.

The various photosensitive drum production methods previously mentioned were used to produce sample photosensitive members which were used for image formation; the obtained images were evaluated by the criteria below.

Sample Photosensitive Members 1~5

The mix ratio of the charge-transporting layer and the overcoat protective layer of the previously mentioned photosensitive drum 1 were comprised as indicated below.

Sample 1: 10 pbw PCZ (molecular weight 50,000 (panlite Ts-2050)), 10 pbw hydrazone compound, 180 pbw THF, and 0.1 pbw orange dye.

Sample 2: 15 pbw PCZ (molecular weight 50,000 (Panlite Ts-2050)), 5 pbw hydrazone compound, 180 pbw THF, 0.1 pbw orange dye.

Sample 3: The surface of the photosensitive member of sample 1 was coated with a 1 μm overcoat layer by a dipping method. Overcoat layer: 10 pbw PCZ (molecular weight 50,000 (Panlite Ts-2050), and 100 pbw THF.

Sample 4: 10 pbw PCZ (molecular weight 20,000 (panlite Ts-2020)), 10 pbw hydrazone compound, 180 pbw THF, 0.1 pbw orange dye.

Sample 5: 5 pbw PCZ (molecular weight 20,000 (panlite Ts-2020)), 15 pbw hydrazone compound, 180 pbw THF, 0.1 pbw orange dye.

Samples 6~13 were prepared in the same manner as sample 1.

The image evaluation method is described below.

1) The respective sample photosensitive members were installed in the printer shown in FIG. 1, and 30,000 prints were made under the conditions described below.

Samples 1~5

Photosensitive member rotational speed Vp: 38 mm/sec

Rotating brush 21: brush fiber material comprised fibers of conductive carbon dispersed in rayon.

Brush fiber length: 5 mm

Shaft (rod) diameter: 6 mm

Fiber density: 50,000 fibers per inch$^2$

Rotational speed Vr: 152 mm/sec in the direction of movement of the photosensitive surface Nip width (contact width with photosensitive drum): 10 mm Print conditions: A4 paper, portrait orientation, B/W ratio 5% character chart, normal environment (20° C., 50%)

Samples 6~13

Various combinations of rotational speed Vr of the rotating brush and the nip width were changed for the samples 1~5. The rotational speed of the photosensitive member, print conditions, and other conditions of the rotating brush were identical to samples 1~5.

Figure 6:
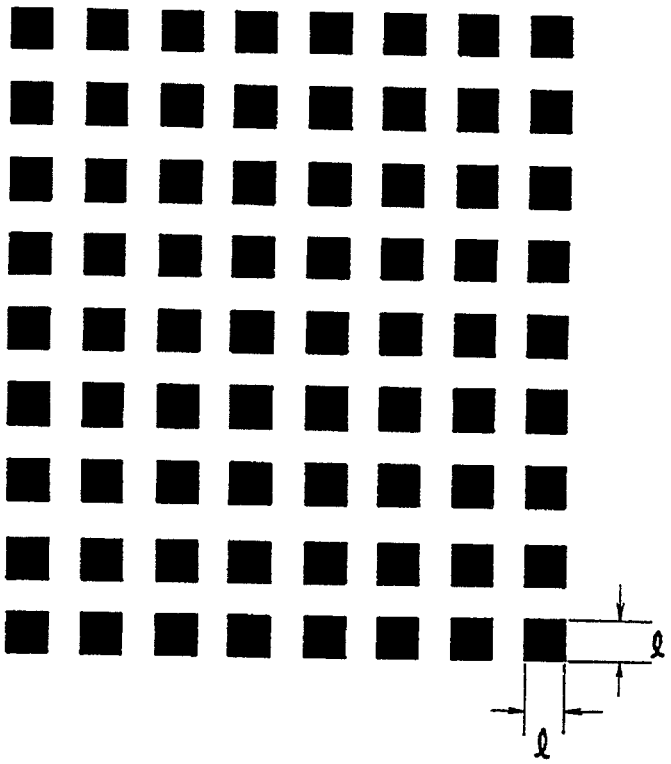
FIG. 6 is an illustration showing an example of a halftone dot pattern.
Figure 7:
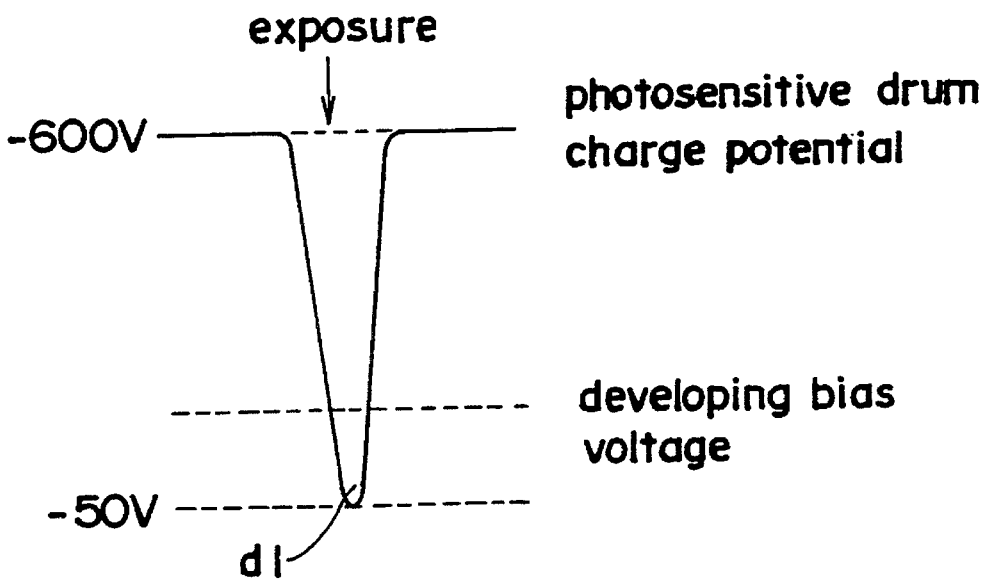
FIGS. 7A and 7B are illustrations showing image drift.
Figure 7:
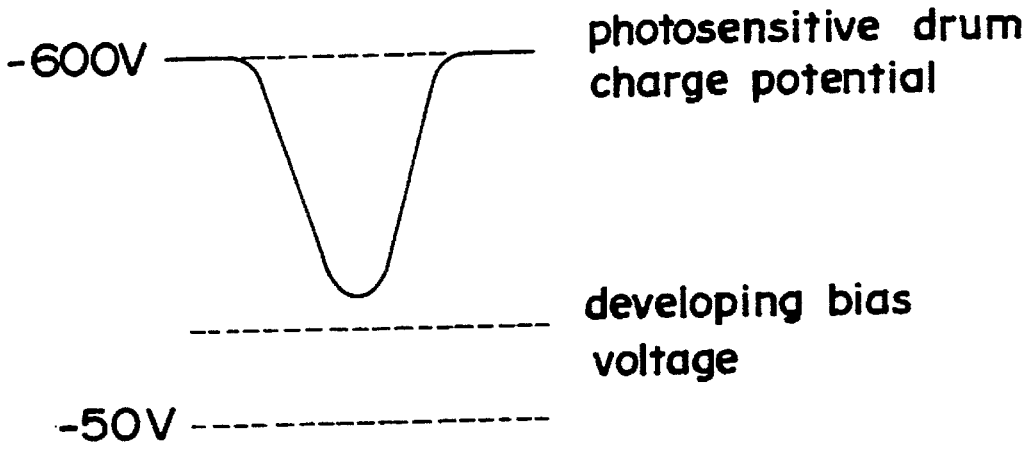

2) After 30,000 printings, the apparatus was allowed to stand overnight, then a single halftone dot image was output under conditions of high temperature and high humidity, and the obtained image was evaluated. The halftone dot image is shown in FIG. 6, and is a 1-ON-3-OFF image at 300 dpi resolution. In FIG. 6, the standard length 1 of the edge of one dot is 84.7 μm.

3) The images obtained in section 2 were evaluated visually and under a 10× microscopic photography. The evaluation rankings were designated (1)~(5), and are defined below.

(1) Missing dots over broad range by visual inspection; unusable.

(2) Local missing dots by visual inspection; unusable.

(3) Slight image drift by visual inspection, but usable.

(4) Clear by visual inspection, but black dots became partially smaller under 10× microscopic photography.

(5) No image drift under visual or 10× microscopic inspection.

The evaluation results are shown in the tables below. In the tables, F represents (nip width)×|Vr−Vp|/Vp). Sample 1 is shown in both tables for easy comparison with the other samples.

| Sample (drum) | 1 | 2 | 3 | 4 | 5 | 6 | 7 | 8 | 9 | 10 | 11 | 1 | 12 | 13 |
|---|---|---|---|---|---|---|---|---|---|---|---|---|---|---|
| Drum hardness (mm) | 50 | 30 | 25 | 90 | 180 | 50 | 50 | 50 | 50 | 50 | 50 | 50 | 50 | 50 |
| NIP Width (mm) | 10 | 10 | 10 | 10 | 10 | 6 | 6 | 6 | 6 | 10 | 10 | 10 | 10 | 10 |
| Vr (mm/sec) | 152 | 152 | 152 | 152 | 152 | 76 | 114 | 152 | 190 | 76 | 114 | 152 | 190 | 412 |
| Vp (mm/sec) | 38 | 38 | 38 | 38 | 38 | 38 | 38 | 38 | 38 | 38 | 38 | 38 | 38 | 38 |
| F (mm) | 30 | 30 | 30 | 30 | 30 | 6 | 12 | 18 | 24 | 10 | 20 | 30 | 40 | 100 |
| Image evaluation | (4) | (3) | (2) | (5) | (5) | (2) | (3) | (4) | (5) | (3) | (4) | (4) | (5) | (5) |

It can be understood from the result of the top table that when the hardness of the photosensitive drum is greater than 30 μm, it is difficult to shave the photosensitive drum and image drift occurs.

In sample 5 wherein the photosensitive drum hardness was 180 μm, image drift was not a problem, but a short service life is a disadvantage. When image formations were accomplished over a long period, pinholes were generated which could cause possible image defects. From the above information, it is understood that a photosensitive member having a hardness of 30 μm or greater but not more than 180 μm is desirable.

It is further understood from the information of the bottom table that when (nip width × |Vr−Vp|/Vp) is less than 10 mm, shaving the drum is difficult and image drift occurs. Although image drift was not a problem in the evaluation of the photosensitive member of sample 13, drive irregularities occurred when the drive torque of the photosensitive member increased. This drive irregularity can be eliminated if a large high-performance motor is used, but from a cost and installation space perspectives it is preferable to set the (nip width × |Vr−Vp|/Vp) at less than 10 mm. Thus, it can be understood that it is desirable to set the brush conditions at (nip width × |Vr−Vp|/Vp) of 10 mm or greater but not more than 100 mm.

Although the in the aforesaid embodiment the rotating brush for shaving the surface of the photosensitive member is combined with a charging member, the rotating brush for shaving the surface of the photosensitive member and the charging member may be provided separately.

The rotating brush for shaving the photosensitive member surface may be combined with a residual developer disrupting member so as to disturb the residual developer remaining on the surface of the photosensitive member after transfer and thereby suppress so-called memory image generation. In this case, consideration should be given to the positioning of the rotating brush, for example, downstream from the transfer position and upstream from the charging position relative to the direction of movement of the photosensitive drum surface.

The photosensitive member used in the present invention is not limited to the function-separated type organic photosensitive member having excellent sensitivity to long wavelength light such as semiconductor laser light (wavelength: 780 nm) and LED light (wavelength: 680 nm) as used in the previously described embodiment.

Usable photosensitive members will have a photosensitivity with respect to long wavelength light as previously mentioned, in an image forming system using long wavelength light of an optical system such as a semiconductor laser (780 nm), LED array (680 nm) and the like. For example, a usable photosensitive member will have a photosensitivity in the visible range in image forming systems having a light source which emits visible light such as a liquid crystal array, PLZT shutter array and the like, image forming systems having a visible light laser as a light source, image forming systems having a fluorescent emitter array as a light source, or analog image forming systems having a visible light source and an optical system of lenses and mirrors such as that of typical copying machines.

The construction of the photosensitive member may be a function-separated organic photosensitive member provided with a separate charge-transporting layer superimposed over a charge-generating layer, or a so-called inverted-lamination type photosensitive member provided with a charge-generating layer superimposed over a charge-transporting layer, or a so-called single-layer type photosensitive member provided with a combined charge-generating function and charge-transporting function.

Photosensitive members suitable for use in the present invention may be provided with an underlayer to improve charging characteristics, image quality, bonding to the substrate and the like. Examples of useful underlayer materials include ultraviolet curing resins, cold-setting resins, thermosetting resins and the like, mixed resins having resistance regulating materials dispersed n the aforesaid resins, vacuum deposition thin film materials formed by vapor deposition or ion plating of metal oxides or metal sulfides or the like in a vacuum, amorphous carbon film produced by plasma polymerization, amorphous silicon carbide film and the like.

The substrate of the photosensitive member suitable for use in the present invention is not specifically limited insofar as the surface of said photosensitive member substrate is electrically conductive, and its configuration may be cylindrical or belt-like in the case of a rotatable type photosensitive member. The surface of the substrate may be subjected to surface toughening process, oxidation process, coloring process and the like.

Furthermore, when a plurality of rotating brushes are in contact with the surface of the photosensitive member as shown in FIG. 5B, the value of (nip width × |Vr−Vp|/Vp) may be set as the value (nip width × |Vr−Vp|/Vp) for the total value of all rotating brushes.

Although the present invention has been fully described by way of examples with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus comprising:

a photosensitive member having a hardness such that a conical diamond produces on a surface of the photosensitive member a scratch of 30 μm or greater but no more than 180 μm in width, when the diamond scratches the surface of the photosensitive member under a vertical load of 50 g and relative speed of 100 mm/min, the diamond having a conical angle of 120° and hemisphere shaped leading edge with a radius of 0.2 mm;

a developing device for developing a latent image formed on the photosensitive member, and for cleaning residual toner on the photosensitive member after transferring the developed image onto a paper; and at least one rotational brush provided in contact with the photosensitive member under the following conditions of:

$$100\ \text{mm} \geqq W \times |Vr - Vp|/Vp \geqq 10\ \text{mm},$$

wherein W is a nip width of the brush relative to the photosensitive member, Vr is a rotational speed of the brush and Vp is a rotational speed of the photosensitive member.

2. The image forming apparatus as claimed in claim 1, wherein said rotational brush is connected with a power source and applied a charging voltage so as to charge the surface of the photosensitive member.

3. The image forming apparatus as claimed in claim 1, wherein said rotational brush is positioned between a portion where the developed image is transferred onto a paper and a portion where the photosensitive member is charged, with respect to a rotational direction of the photosensitive member.

4. The image forming apparatus as claimed in claim 1, wherein said developing device develops the latent image with a mono-component developer.

5. The image forming apparatus as claimed in claim 4, wherein said developing device develops the latent image by reversal development.

6. An image forming apparatus comprising:

a photosensitive member having a hardness such that a conical diamond produces on a surface of the photosensitive member a scratch of 30 μm or greater but no more than 180 μm in width, when the diamond scratches the surface of the photosensitive member under a vertical load of 50 g and relative speed of 100 mm/min, the diamond having a conical angle of 120° and hemisphere shaped leading edge with a radius of 0.2 mm;

a developing device for developing a latent image formed on the photosensitive member, and for cleaning residual toner on the photosensitive member after transferring the developed image onto a paper; and a charging device including at least one rotational charging brush for charging the photosensitive member to form the latent image, the charging brush being provided in contact with the photosensitive member under the following conditions of:

$$100\ \text{mm} \geqq W \times |Vr - Vp| / Vp \geqq 10\ \text{mm},$$

wherein W is a nip width of the brush relative to the photosensitive member, Vr is a rotational speed of the brush and Vp is a rotational speed of the photosensitive member.

* * * * *